US012590785B1

(12) United States Patent
Haas

(10) Patent No.: US 12,590,785 B1
(45) Date of Patent: Mar. 31, 2026

(54) TARGET PINS AND TARGET PIN HOLSTER SYSTEM

(71) Applicant: Corey Haas, Crest Hill, IL (US)

(72) Inventor: Corey Haas, Crest Hill, IL (US)

( * ) Notice: Subject to any disclaimer, the term of this patent is extended or adjusted under 35 U.S.C. 154(b) by 346 days.

(21) Appl. No.: 18/412,767

(22) Filed: Jan. 15, 2024

Related U.S. Application Data

(60) Provisional application No. 63/480,289, filed on Jan. 17, 2023.

(51) Int. Cl.
*F41J 1/10* (2006.01)

(52) U.S. Cl.
CPC ..... *F41J 1/10* (2013.01)

(58) Field of Classification Search
CPC ..... F41J 1/10
USPC ..... 273/348
See application file for complete search history.

(56) References Cited

U.S. PATENT DOCUMENTS 3,846,873 A * 11/1974 Saunders ..... F41J 3/0004 411/456
11,385,032 B2 7/2022 Wilson
2016/0370152 A1* 12/2016 Tomkins ..... F16B 25/106

* cited by examiner

*Primary Examiner* — Michael G Lee
(74) *Attorney, Agent, or Firm* — Donald J. Ersler

(57) ABSTRACT

A target pin holster system includes target pins, which are used to secure a paper target face to a penetrable archery target, and a holster that securely stores the target pins when they are not in use. Each target pin houses an embedded magnet which is attracted to a magnet embedded in the target pin retention holster resulting in safe and secure storage for the target pins when they are not in use.

11 Claims, 11 Drawing Sheets

TARGET PINS AND TARGET PIN HOLSTER SYSTEM

CROSS REFERENCE TO RELATED APPLICATIONS

This application claims the priority benefit of U.S. Provisional Patent Application No. 63/480,289 filed Jan. 17, 2023 for "Push Pins and Push Pins Holster System."

BACKGROUND OF THE INVENTION

1. Field of the Invention

This application relates to archery target pins and the holster system which houses the target pins when they are not in use.

2. Discussion of the Prior Art

Archery is a target sport in which the competitor, or archer, is assessed based on their ability to launch an arrow at a target accurately. The archery target is comprised of a target face, which is usually the thickness of heavy paper, and a penetrable target butt. The target face usually contains printed scoring rings for assessing the archer's shots and is attached to the target butt with pins or nails. The target butts can be made from variety of material including but not limited to solid foam, layered foam, straw, excelsior, polymer sheets, and nylon bags filled with shredded material.

Normal attachment of target pins to a target butt requires (4) target pins; one target pin fixed to each corner of the square target face. In the past, archers have used a variety of nails or similar materials for target pins. In recent years, ergonomically designed archery target pins have been developed and have been used for attaching the target faces to the penetrable archery butts. Modern target pins provide for an easy installation of target faces but often lack a safe and secure means of storage when the target pins are not in use. Target pins embody sharp nails or pins that, when not in use, present a possible safety hazard when not secured in a storage device. It is the responsibility of the archer to provide a bag or container for target pin storage purposes. Patent Ser. No. 11/385,032 to Wilson discloses an archery target pin.

SUMMARY OF THE INVENTION

The target pins and target pin retaining holster, according to the present disclosure, uses embedded magnets in both the target pins and target pin holster in order to provide an easy and safe means of storage when the target pins are not in use. The target pins can be constructed of one solid body or of multiple components. The target pin storage holster can be of various designs and dimensions as long as it can house the target pins with the aid of properly oriented embedded magnets. When the target pins are no longer needed to pin an archer's paper target face to an archery target, they are individually removed. After removing each target pin, the sharp nail or nail like component of the target pin can be inserted into one of the target pin holster's bored holes. When the target pin is almost completely inserted into the bored hole, one of the target pin holster's magnets will attract the target pin's magnet and securely retain the target pin until the pin is ready for its next use. The attraction of the holster's magnets and the target pin's magnets should be strong enough to securely retain the target pin within the holster but weak enough to allow for target pin removal.

DETAILED DESCRIPTION OF THE DRAWINGS

Figure 1:
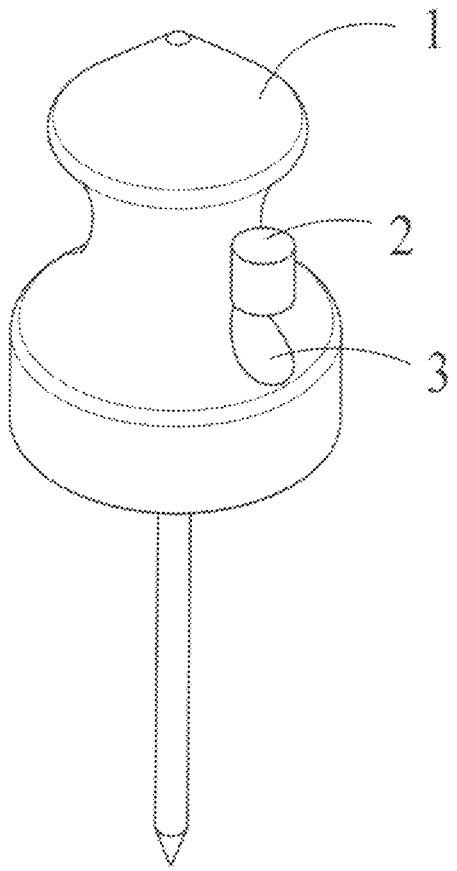
FIG. 1 is a top partially exploded perspective view of a single body target pin with an uninstalled magnet.
Figure 2:
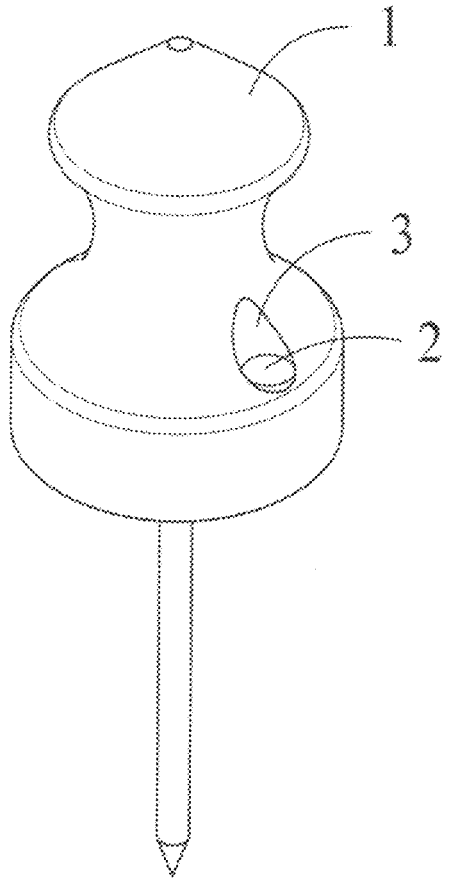
FIG. 2 is a top perspective view of a single body target pin with an installed magnet.
Figure 3A:
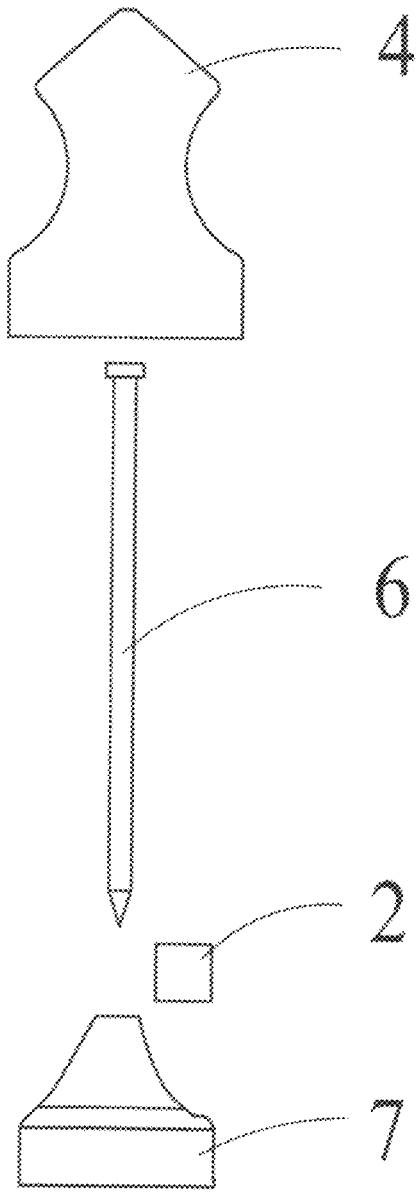
FIG. 3A is an exploded side elevation view of a single body pin.
Figure 3B:
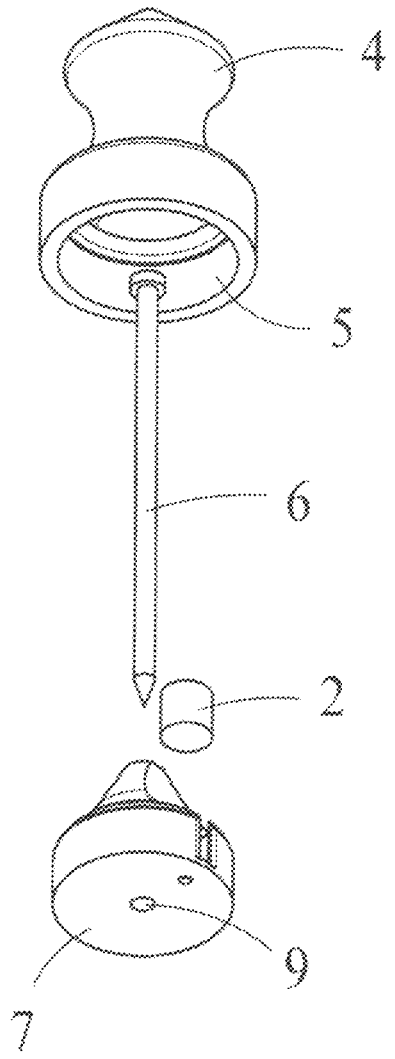
FIG. 3B is a bottom exploded perspective view of a single body target pin.
Figure 3C:
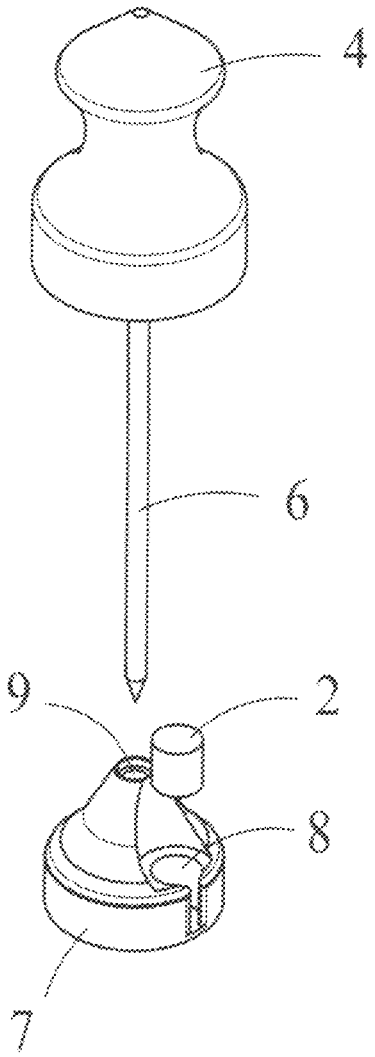
FIG. 3C is a top exploded perspective view of a single body target pin.

Turning now to the exemplary embodiments depicted in the drawings. FIG. 1 is a top partially exploded perspective view of a single body target pin 1 which features a bored magnet hole 3 and an uninstalled magnet 2. FIG. 2 is a top perspective view of the single body target pin 1 and its inserted magnet 2 seated in its bored magnet hole 3. FIG. 3A is an exploded side elevation view of the single body target pin 1. This exploded view illustrates the layout of the target pin body shell 4, the target pin nail 6, the magnet 2 and the target pin insert 7 prior to assembly. FIG. 3B is an exploded bottom perspective view of the single body target pin 1. This exploded view illustrates the layout of the target pin body shell 4 and its hollow insert cavity 5, the target pin nail 6, the magnet 2 and the target pin insert 7 prior to assembly. The bottom of the insert's passthrough nail hole 9 is visible from this angle. FIG. 3C is an exploded top perspective view of the single body target pin 1. This exploded view illustrates the layout of the target pin body shell 4 and its hollow insert cavity 5, the target pin nail 6, the magnet 2 and the target pin insert 7 prior to assembly. The top of the insert's passthrough nail hole 9 and magnet cavity 8 is visible from this angle.

Figure 4A:
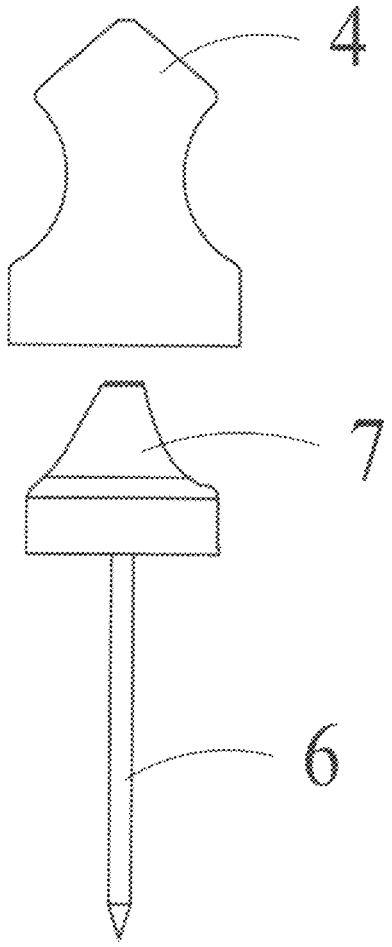
FIG. 4A is a partially exploded side elevation view of a single body target pin.
Figure 4B:
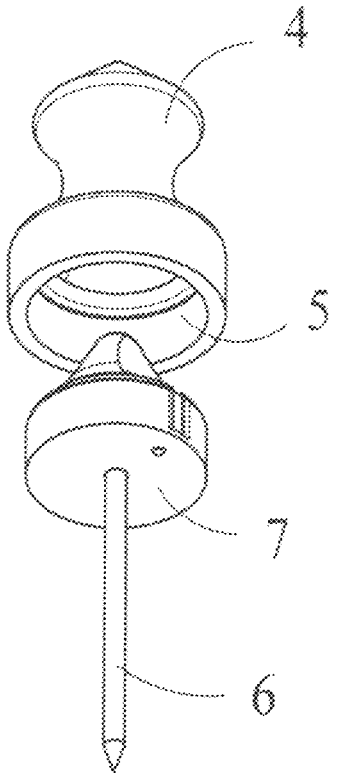
FIG. 4B is a bottom partially exploded perspective view of a single body target pin.
Figure 4C:
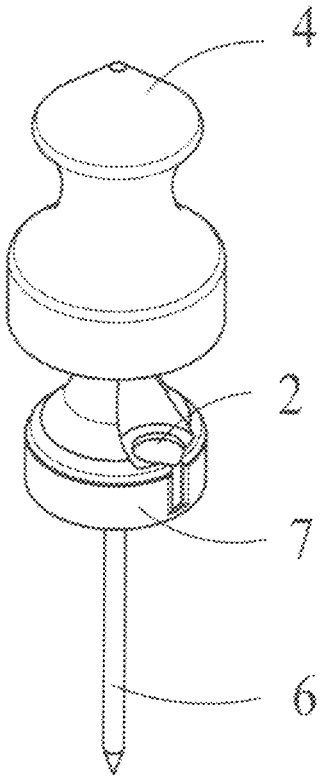
FIG. 4C is a top partially exploded perspective view of a single body target pin.

FIG. 4A is a partially exploded side elevation view of the single body pin 1. This illustration shows the target pin body shell 4 and the target pin nail 6 that is seated in the target pin insert 7. FIG. 4B is a partially exploded bottom perspective view of the single body target pin 1. This illustration shows the target pin nail 6 seated in the target pin insert 7 directly below the insert cavity 5 created by the hollow of the target pin shell 4. FIG. 4C is a partially exploded top perspective view of the single body target pin 1. This illustration shows the target pin nail 6 and the magnet 2 seated in the target pin insert 7 and located below the target pin body shell 4.

Figure 5A:
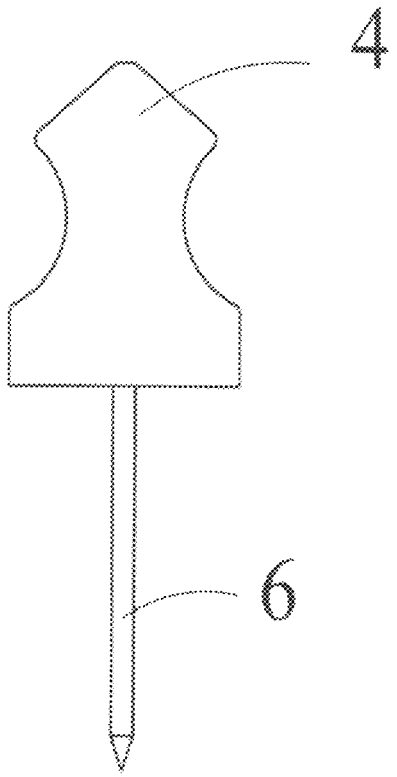
FIG. 5A is a side elevation view of a single body target pin.
Figure 5B:
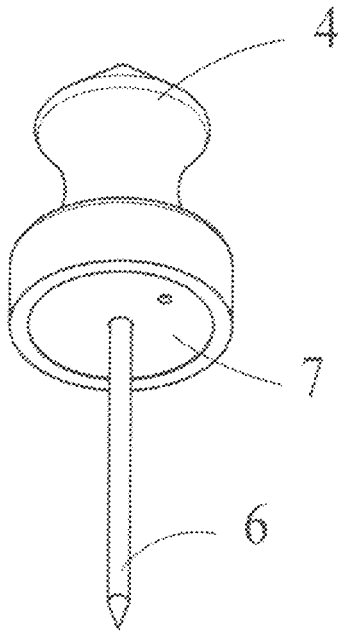
FIG. 5B is a bottom perspective view of a single body target pin.
Figure 5C:
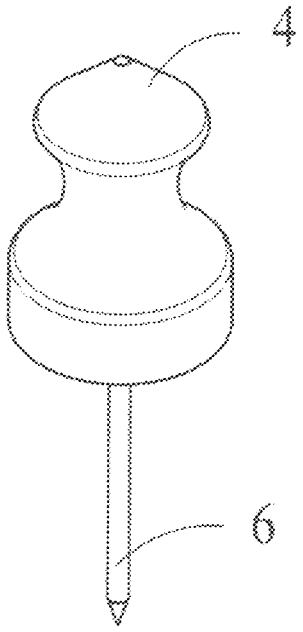
FIG. 5C is a top perspective view of a single body target pin.
Figure 6A:
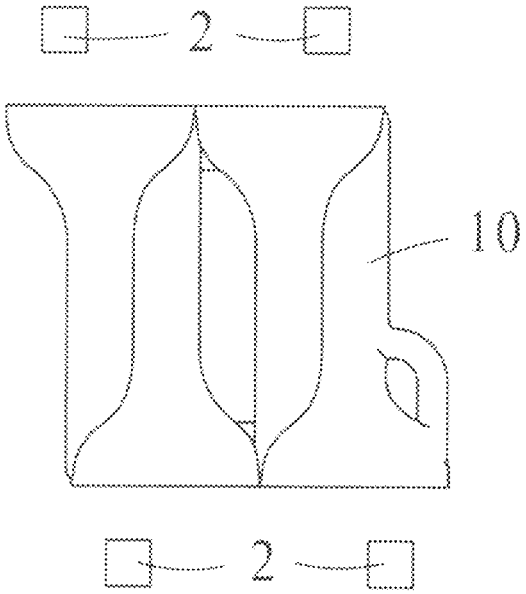
FIG. 6A is an exploded side elevation view of a target pin holster.
Figure 6B:
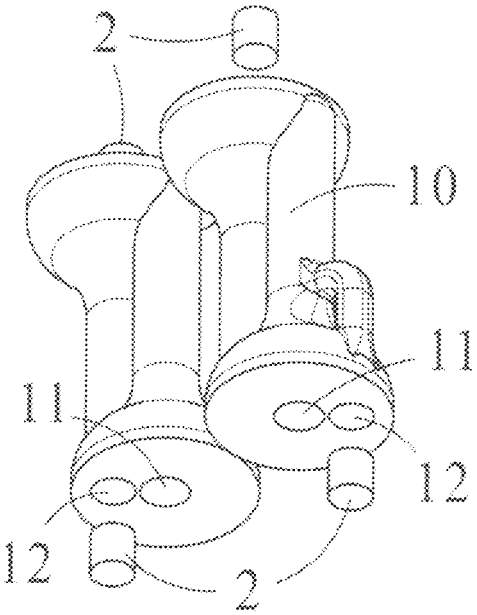
FIG. 6B is an exploded bottom perspective view of a target pin holster.
Figure 6C:
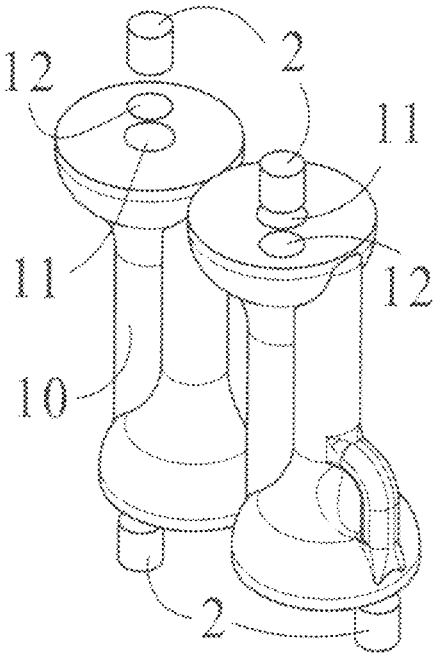
FIG. 6C is an exploded top perspective view of a target pin holster.

FIG. 5A is a side elevation view of the single body target pin 1 with the target pin body 4 and the target pin nail 6 visible. FIG. 5B is a bottom perspective view of the target pin 1. The insert 7 and its installed components, including the target pin nail 6 have been pressed into the target pin body shell 4 and is ready for use. FIG. 5C is a top perspective view of the single body target pin 1 with the target pin shell 4 and the target pin nail 6 visible. FIG. 6A is an exploded side elevation view of a target pin holster body 10 and its uninstalled magnets 2. FIG. 6B is an exploded bottom perspective view of the target holster comprising of target pin holster body 10, the holster's bored magnet holes 12, the holster's bored target pin nail hole 11, and the uninstalled holster magnets 2. FIG. 6C is an exploded top perspective view of the target holster comprising of target pin holster body 10, the holster's bored magnet holes 12, the holster's bored target pin nail hole 11, and the uninstalled holster magnets 2.

Figure 7A:
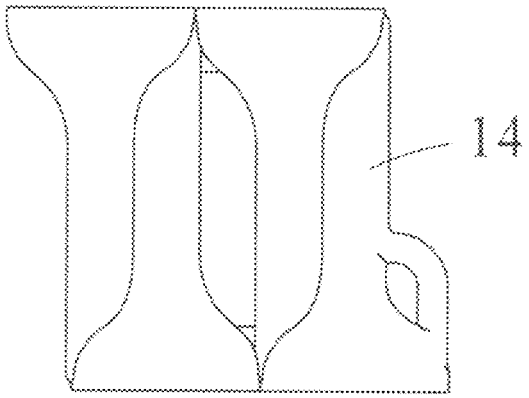
FIG. 7A is a side elevation view of a target pin holster.
Figure 7B:
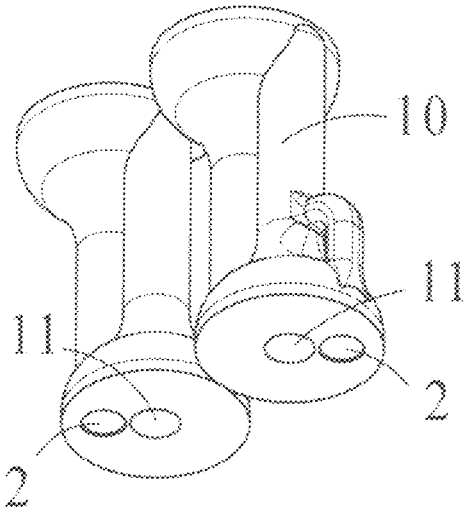
FIG. 7B is a bottom perspective view of a target pin holster.
Figure 7C:
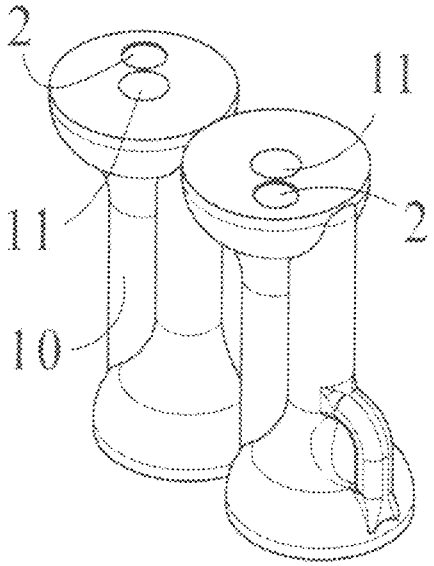
FIG. 7C is a top perspective view of a target pin holster.
Figure 8A:
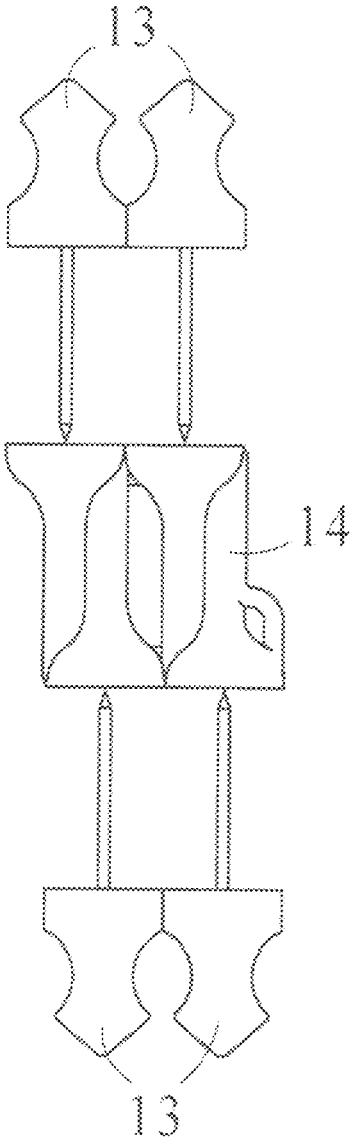
FIG. 8A is an exploded side elevation view of a target pin holster with four single body target pins.
Figure 8B:
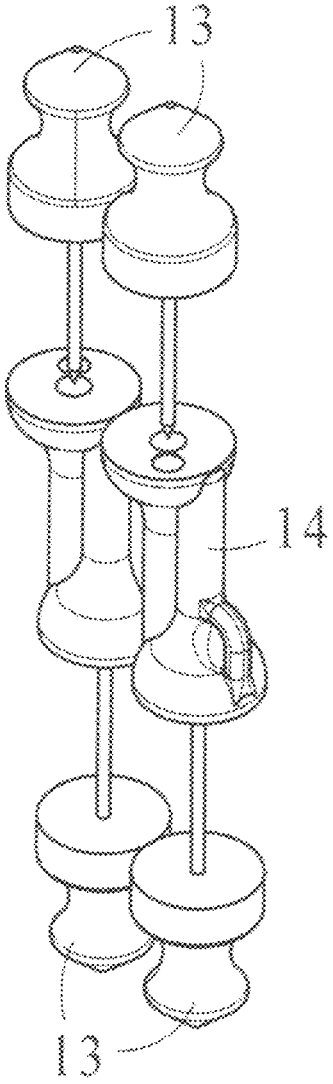
FIG. 8B is an exploded top perspective view of a target pin holster with four single body target pins.
Figure 9A:
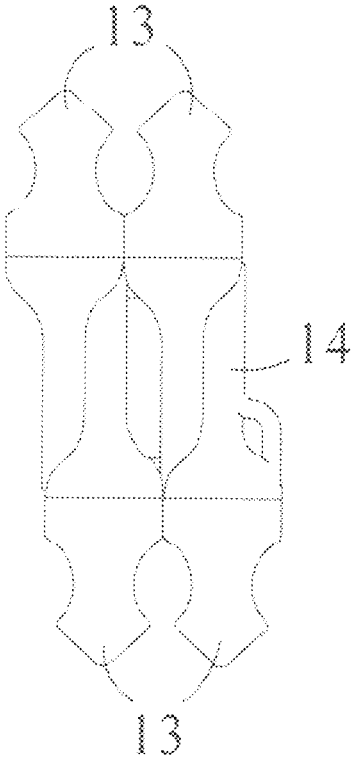
FIG. 9A is a side elevation view of a target pin holster with four inserted single body target pins.
Figure 9B:
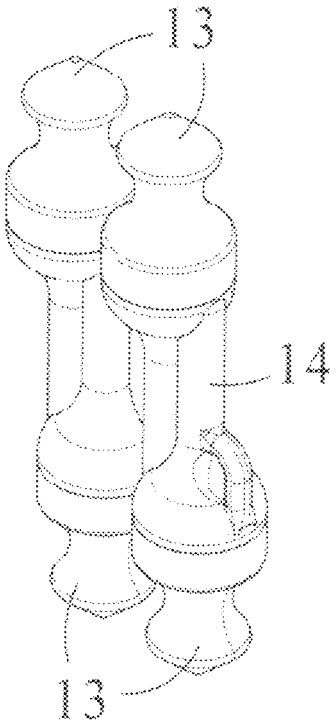
FIG. 9B is a top perspective view of a target pin holster with four inserted target pins.

FIG. 7A is a side elevation view of a target pin holster 14. FIG. 7B is a bottom perspective view of the target pin holster 14 comprised of a target pin holster body 10 and installed magnets 2 which are located adjacent to the holster's bored nail cavities 11. FIG. 7C is a top perspective view of the target pin holster 14 comprised of a target pin holster body 10 and installed magnets 2, which are located adjacent to the nail cavities 11. FIG. 8A is an exploded side elevation view of four target pins 13 that are aligned for insertion into the target pin holster 14. FIG. 8B is an exploded top perspective view of four target pins 13 that are aligned for insertion into the target pin holster 14. FIG. 9A is a side elevation view of four target pins 13 that have been inserted and magnetically seated to the target pin holster 14. FIG. 9B is a top perspective view of four target pins 13 that have been inserted and magnetically seated to the target pin holster 14.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A target pin, comprising:

a target pin body includes a top and a bottom;

a pin magnet is retained in said bottom of said target pin body; and a target nail extends from said bottom of said target pin body.

2. The target pin of claim 1, further comprising:

a target pin insert is retained on a bottom of said target pin body, said pin magnet is retained in said target pin insert, said target nail is retained in said target pin insert.

3. The target pin of claim 2, wherein:

said target pin body includes an insert cavity formed on said bottom thereof to receive said target pin insert.

4. The target pin of claim 2, wherein:

a magnet cavity is formed in a top of said target pin insert to receive said pin magnet.

5. A target pin holster for retaining at least one target pin, each target pin includes a target nail and a pin magnet, the target nail extends from a bottom of the target pin, the pin magnet is retained in a bottom of the target pin, comprising:

at least one target pin holster body includes a lengthwise opening for receiving the target nail; and a holster magnet is retained in a top of each one of said at least one target pin holster body, wherein said holster magnet attracts the pin magnet to retain the target pin in said target pin holster body.

6. The target pin holster of claim 5, wherein:

each one of said at least one target pin holster includes a magnet cavity formed in a top thereof.

7. A target pin holster system, comprising:

a target pin body includes a top and a bottom;

a pin magnet is retained in said bottom of said target pin body;

a target nail extends from said bottom of said target pin body;

at least one target pin holster body includes a lengthwise opening for receiving the target nail; and a holster magnet is retained in a top of each one of said at least one target pin holster body, wherein said holster magnet attracts said pin magnet to retain said target pin in said target pin holster body.

8. The target pin holster system of claim 7, further comprising:

a target pin insert is retained on a bottom of said target pin body, said pin magnet is retained in said target pin insert, said target nail is retained in said target pin insert.

9. The target pin holster system of claim 8, wherein:

said target pin body includes an insert cavity formed on said bottom thereof to receive said target pin insert.

10. The target pin holster system of claim 8, wherein:

a magnet cavity is formed in a top of said target pin insert to receive said pin magnet.

11. The target pin of claim 7, wherein:

each one of said at least one target pin holster body includes a magnet cavity formed in a top thereof.

* * * * *